US007086324B2

(12) United States Patent
Buettner et al.

(10) Patent No.: US 7,086,324 B2
(45) Date of Patent: Aug. 8, 2006

(54) SURFACES OF THE POLYGON OR PISTON BASE STROKE DISC OF INJECTION PUMPS AND PROCESSES FOR THEIR MANUFACTURE

(75) Inventors: Ulrich Buettner, Senden (DE); Hans-Juergen Fuesser, Gerstetten (DE); Volker Lagemann, Ulm (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/499,899

(22) PCT Filed: Oct. 22, 2003

(86) PCT No.: PCT/DE03/03512

§ 371 (c)(1),
(2), (4) Date: Jun. 23, 2004

(87) PCT Pub. No.: WO2004/040134

PCT Pub. Date: May 13, 2004

(65) Prior Publication Data

US 2005/0063835 A1 Mar. 24, 2005

(30) Foreign Application Priority Data

Oct. 24, 2002 (DE) ..... 102 49 818

(51) Int. Cl.
*F04B 1/04* (2006.01)

(52) U.S. Cl. ..... 92/129; 92/159

(58) Field of Classification Search ..... 91/491; 92/72, 129, 158, 159

See application file for complete search history.

(56) References Cited

U.S. PATENT DOCUMENTS 1,016,561 A * 2/1912 Grabler ..... 92/158
3,441,328 A 4/1969 Hurley et al.
3,628,425 A * 12/1971 Morita et al. ..... 91/491
4,693,617 A 9/1987 Roemer et al.

(Continued)

FOREIGN PATENT DOCUMENTS

DE 546 781 C 3/1932

(Continued)

OTHER PUBLICATIONS

German codes of practice DIN 1494 Teil 3.

*Primary Examiner*—Thomas E. Lazo
(74) *Attorney, Agent, or Firm*—Akerman Senterfitt; Stephen A. Pendorf

(57) ABSTRACT

The invention relates to the surfaces of the polygon (2) and/or the plunger foot plate (3) of a high-pressure pump for a diesel motor, at least one of the surfaces having cavities at least in the contact area between the polygon (2) and the plunger foot plate (3). According to the invention the face of the plunger foot plate (3) lying opposite the polygon (2) is concave, at least in the load-free state and the cavities have a depth of between 5 and 50 μm, a width of between 30 and 100 μm and a length of at least 100 μm, or a diameter ranging between 30 and 100 μm. The edges of the cavities are rounded. The invention also relates to a method for producing said surfaces, according to which the cavities are first created in the surface by means of chemical etching, blasting using blasting agents or by means of a laser removal process, the surface is subsequently polished in a vibratory grinding process and the edges of the cavities are rounded.

9 Claims, 3 Drawing Sheets

U.S. PATENT DOCUMENTS 4,760,771 A * 8/1988 Felici et al. ..... 92/159
5,441,439 A 8/1995 Grimm et al.
5,462,362 A 10/1995 Yuhta et al.
5,823,091 A * 10/1998 Collingborn ..... 92/72
5,937,734 A 8/1999 Stiefel et al.
5,979,297 A * 11/1999 Ricco ..... 92/129
6,077,056 A * 6/2000 Gmelin ..... 92/158
6,095,690 A 8/2000 Niegel et al.
6,350,107 B1 * 2/2002 Hamutcu ..... 92/72
6,722,864 B1 * 4/2004 Suzuki et al. ..... 92/72
6,739,238 B1 * 5/2004 Ushijima et al. ..... 92/158
6,910,407 B1 * 6/2005 Furuta ..... 92/72

FOREIGN PATENT DOCUMENTS

DE 27 44 006 B 10/1978
DE 33 28 509 4/1985
DE 41 07 952 A 9/1991
DE 197 00 339 A1 7/1997
DE 198 36 901 A 2/2000
DE 199 53 576 A1 6/2001
EP 0 565 742 A 10/1993

* cited by examiner

Direction of Sliding

SURFACES OF THE POLYGON OR PISTON BASE STROKE DISC OF INJECTION PUMPS AND PROCESSES FOR THEIR MANUFACTURE

CROSS REFERENCE TO RELATED APPLICATION

This application is a national stage of PCT/DE2003/003512 filed Oct. 22, 2003 and based upon DE 102 49 818.0 filed Oct. 24, 2002 under the International Convention.

BACKGROUND OF THE INVENTION

1. Field of Invention

The invention is concerned with surface of the polygon (2) and/or plunger foot plate (3) of an injection pump, especially of a high-pressure injection pump, for a diesel motor, where at least one of the surfaces has cavities at least in the contact area between the polygon (2) and the plunger foot plate (3), it is also concerned with a method for their production.

2. Related Art of the Invention

It is known to produce the sliding surfaces in motors or pumps in which different bodies are arranged against one another in a sliding manner, and if possible, without friction with minimum friction. In order to achieve this, the surfaces of the bodies are designed to be very smooth, that is, without cavities or protrusions, or they are machined in a manufacturing process so that no cavities or protrusions are present which would produce undesirable friction, for example, in injection pumps for diesel vehicles having a rotating polygon which comes into contact with plunger foot plates in a sliding manner and cooperates with these. These sliding surfaces are made to be very smooth to reduce friction so that no cavities or protrusions are present which could have an undesired effect on friction. The diesel fuel present acts as lubricant on these contact surfaces.

SUMMARY OF THE INVENTION

It is the task of the invention to provide at least one surface of the polygon (2) and/or the plunger foot plate (3) of a high-pressure injection pump with devices to reduce the friction as well as a method for the production of a surface which shows especially low frictional values when used in combination with a lubricant.

This task is solved by providing the surface of a polygon and/or a footplate of a high-pressure injection pump of a diesel motor with cavities, wherein the cavities have a depth in the range from 5 to 50 μm and (a) a width of 30 to 100 μm and a length of at least 100 μm or (b) a diameter in the range of 30 to 100 μm, and wherein the edges of the cavities are rounded, as well as with a method for the production of a surface with these characteristics.

Advantageous further developments are discussed below.

In the following, for brevity of the description, the polygon (2) and the plunger foot plate (3) are sometimes referred to collectively simply as bodies, since the description of the surfaces can refer frequently both to the polygon (2) as well as to the plunger foot plate.

The surface according to the invention of a body on which another body can be arranged in a sliding manner, sliding against one another in a preferred sliding direction, exhibits cavities for accepting a sliding agent, which is, for example, preferably the fuel in the case of a fuel pump or injection pump. The recesses are designed here in such a way that their pronounced main orientation runs not only in the direction of sliding, but especially essentially or substantially perpendicular to the sliding direction, or are arranged arbitrarily without any specific main direction. The more the main orientation differs from the direction of sliding, the better is the reduction of friction. The cavities on the surface do not all have to have the desired orientation, it is sufficient when a considerable part of the cavities has the desired orientation. The more pronounced the main orientation and the pronounced transverse orientation to the direction of sliding, the better is the reduction in friction. If the main orientation of the cavities is not pronounced or is only slightly pronounced, this leads to a lower but still considerable improvement of the frictional values. Thus, the invention departs from the conventionally accepted wisdom of making the surfaces smoother and smoother, and instead makes them deliberately rougher.

In order to achieve an especially effective reduction of friction, the depth of the cavities is not small, but is chosen to have a considerable size, and thus it is chosen to be greater than 5 μm, however, preferably below 50 μm. With the aid of this considerable depth, it is ensured that a sufficient reservoir of sliding agent is present, which significantly reduces the friction between bodies, of which at least one has a surface according to the invention. If the depth is chosen to be too small, especially in the range of 1 or below 1 μm or a few μm, then there is a reduction of friction, but not to the extent according to the invention.

A significant increase of the reduction in friction is no longer provided if the depth is increased further. This is especially true when the depth is significantly greater than 50 μm and the largest lateral extension of the cavities is of the same order of magnitude, that is, especially the length of the cavities. It was found to be especially advantageous to form cavities with a depth of about 20 to 30 μm and here especially the lateral extension of the cavity is to be provided in the range of 100 μm. It was found especially expedient to make the cavities substantially circular and to make them to have a diameter of 30 to 100 μm or a width of 30 to 100 μm and a length of at least 100 μm. Exactly by these two designs, a very effective formation of cavities is achieved with regard to the reduction of the friction of bodies with surfaces with the described cavities. Exactly as a result of these dimensions of the cavities, a very good compromise is achieved between the cost of manufacture of the cavities and thus the cost of manufacture of the surface with cavities, and the reduction of friction. When the cavities have such a shape according to the invention, it is made possible on the one hand to make sufficient sliding agent available, and on the other hand, to have to provide only small amounts of necessary sliding surfaces for advantageous large-area distribution of the forces between the bodies for reduction in friction and the resulting possible damage to the bodies.

Using such design of the cavities, it becomes possible to create reservoirs for the sliding agent on the surface from which the sliding agent can be moved into the gap between the bodies, so that always sufficient sliding agent supply is available to the frictional surfaces or contact surfaces between the bodies.

It was found to be especially expedient to design the cavities in the form of cups, troughs, grooves or trenches, and to direct these preferably transversely to the preferred direction of sliding or to the expected direction of sliding. In order to create cup-, trough-, groove- or trench-shaped cavities, especially methods of surface grinding especially transversely to the expected direction of sliding, blasting especially with sand or corundum, chemical etching especially using masks, and/or laser removal processes were found to be useful. Surface grinding proved to be a very simple, cost-effective and very efficient method.

According to a preferred embodiment of the invention, the protrusions which are arranged between the cavities and which are formed by these are designed in such a way that they are formed in a significant proportion to be flat or without essentially any elevations protruding beyond this. This is achieved especially by the fact that, in a manufacturing step which follows the formation of the cavities, the surface is evened out entirely or partially by vibratory grinding so that it is flat on a significant part of it. Due to these flat parts of the surface of the protrusions, it is made possible to increase the contact area on which the two bodies are supported on one another slidingly, and, as a result, the surface load and thus the frictional effects and the danger of corrosion and disturbances are reduced. As a result, the life of the surface, of the body with the surface, or of the pair of bodies sliding against each other is significantly increased.

Especially, it was found to be appropriate to have the transition regions in which the cavities encounter the protrusions not to be abrupt and especially not to be allowed to bump against each other hard along an edge, but to form the transition regions in a rounded manner. As a result of this, it is made possible to improve the transport of the sliding agent from the cavities into the contact area between the two bodies and as a result to achieve a floating, especially in combination with the creation of a greater distance between the bodies and thus enhancement of the sliding. This leads to an improved sliding effect, especially to reduced friction between the two bodies sliding against one another.

Moreover, it was found especially useful to form the cavities in a wedge-like manner, narrowing in the preferred sliding direction, which especially enhances the above-mentioned effect in combination with the rounded transition regions, or makes these effects possible. This design of the transition region or the narrowing design of the cavities makes an especially advantageous microhydrodynamic behavior of the sliding agent possible with regard to the bodies sliding against one another.

In addition, it was found especially useful to coat the surfaces at least partly. In this case, the coatings preferably are chosen so that, on the one hand, they have a friction-reducing or a corrosion-reducing action. Especially coatings with tungsten carbide or tungsten carbide carbon coatings or pure carbon coatings were found to be especially useful. Here, especially a coating of the Balzer company called Balinit was found to be suitable. In addition, or as a completion, it was found advantageous to harden the surface by carbonitridation or nitridation, which improves the stability of the surface against mechanical load, especially by friction.

The bodies, the surface of which is provided with the cavities according to the invention, is preferably made of high-alloy steels, which are themselves very corrosion resistant, have good dimensional stability and a satisfactory frictional coefficient. These high-alloy steels can be worked well by the methods for the production of the surface structure, especially by surface grinding, blasting, especially with corundum or sand, chemical etching, laser removal process, carbonitridation or nitridation, so that the advantageous effects are manifested to an especially high degree. The use of 25MoCR4E steel was found to be especially advantageous.

According to a further development of the invention, the body is designed to be concave at least partially in the area in which it is in contact or is to come into contact with the second body. Preferably, the edge area of the region which is in contact with the second body is designed to be concave. Due to this concave design, a trough is formed in which considerable amounts of the sliding agent can be enclosed and which can act as a macroscopic reservoir for the sliding agent. It is especially useful when the concave area of the surface covers an area in which the significant pressure load of one body on the other is expected. As a result of this, it becomes possible to produce a uniform, macroscopic sliding film between the bodies which reduces the friction between the two bodies significantly. If, in addition to concave design, the use of the cavities according to the invention is applied, this effect of reduction of friction is improved considerably.

Preferably, the edge area of the region, which is in contact with the second body, is designed to be convex. As a result of this convex design, a wedge-like narrowing gap is produced between the two bodies, which results in the development of a sliding film by the sliding agent and thus in an improvement of the friction values. It was found especially useful to design the curvature of the of the convex edge area so that it satisfies an exponential, logarithmic or integral rational function of higher order. As a result of this design, it is made possible to create a body or a surface which is simple to produce by manufacturing techniques and which is characterized by low frictional values. It was found to be especially useful to provide this design of the edge areas in combination with the cavities according to the invention in the contact area. As a result of this, an especially effective reduction of the friction is provided by the especially advantageous action of the sliding agent.

Moreover, the invention is concerned with a body which forms one of a pair of bodies with a second body, where the two bodies are in a sliding contact with each other along a surface or a line or are designed for this. Here the surface which is provided for contact is equipped with the cavities according to the invention and/or with a concave design in the central region or with a convex design of the edge in the edge region. As a result of these different alternatives, designs of the contact area by itself or in combination with another provides for the creation of a very advantageous body or pair of bodies which is characterized by especially low frictional values and low corrosion and thus stability to aging during operation with sliding agents.

As especially advantageous embodiments of the body or body pairs, the following examples were found to be especially useful, without these representing a limitation. For example, valves with valve seat, pistons with cylinder running surfaces, piston ring with cylinder running surfaces, polygons with piston disk or tappets with valve shaft. Moreover, many other body pairs can be considered which are characterized by mutual surface sliding in the presence of a sliding agent, for example in motors or pumps or gears or toothed wheels. When the described surfaces according to the invention are applied, these arrangements prove to have very low friction and are very stable.

According to the invention for the production of the surface according to the invention, the cavities for holding a sliding agent are created by specific surface treatments of the body. Especially, this is done by surface grinding transversely to the expected direction of sliding, or essentially at an angle to the expected direction of sliding, by surface blasting of the surface, for example, with sand or corundum or other hard particles of a predetermined shape, by chemical etching with or without the use of masks and/or by only or additional use of laser methods for removal of material.

These methods make it possible to form the cavities on or in the surface of the body. These cavities are provided for retaining the sliding agent and make possible especially effective sliding and thus a very effective reduction of the friction especially when forming the cavity with a main extension direction which is oriented slanted or transverse or essentially transverse to the preferred direction of sliding.

When using etching methods for the production of the cavities, wet chemical methods with or without current as well as dry etching methods, for example with plasma, were found to be useful. In the wet chemical etching method especially those were found to be useful which provide the shape of the cavities with the use of masks and these were especially efficient and cost-effective. These are characterized by especially uniform and calculable realization of the cavities both with regard to arrangement and dimensions, especially with regard to the distance between the cavities. This leads to very high-quality low-friction surfaces. In order to produce the etching masks, it was found to be especially useful to employ laser methods or air jet methods with abrasive media in which material is removed in a targeted manner at the desired location of the mask to be produced. Moreover, it was found to be a very simple and effective method to produce the holes in the etching mask with the aid of a pin-feed drum or a stamp with the corresponding protrusion. This leads to a very cost-effective production of the etching masks and makes repeated production of identical or largely identical etching masks, which are used up, damaged or destroyed during the manufacturing process of the cavities. Then, with the aid of the etching masks, corresponding to the known photolithographic processes or photolithographic etching processes corresponding to the method of manufacture of printed circuits, the surfaces of the bodies according to the invention can be treated so that, after the conclusion of the etching processes, the cavities are present in the desired amount with the desired dimensions and the desired mutual distances.

It was found to be especially expedient to level the surface, especially the protrusions produced by the cavities using vibratory grinding after the formation of the cavities, in a subsequent step, to increase as a result the contact area of the supporting surface of the two bodies and as a result to reduce the pressure load and the local load and thus to reduce the corrosion load. This leads to a significantly increased life of the two bodies.

Moreover, it was found to be especially useful to subject the surface partially or entirely to a hardening and/or to a coating to improve the sliding and/or to reduce corrosion. As a result, additional improvement of the stability of the bodies or of the surface of the bodies is achieved.

BRIEF DESCRIPTION OF THE DRAWINGS

The invention will be explained in more detail below with the on the basis of figures. The embodiments of the invention represented in the figures are only given as examples and serve for more detailed explanation of the invention. The invention is not limited to the represented embodiment of the invention.

DETAILED DESCRIPTION OF THE INVENTION

Figure 1:
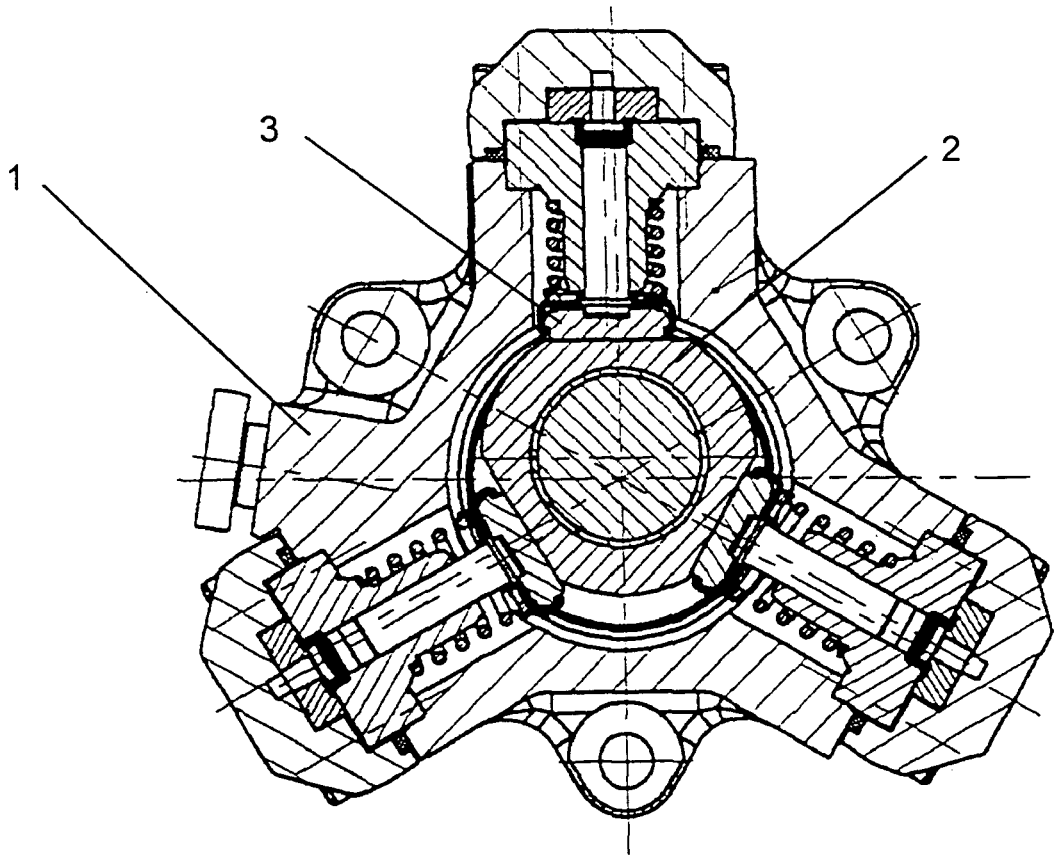
FIG. 1 shows an injection pump for a diesel motor.

FIG. 1 shows a high-pressure injection pump for a diesel motor in which, in the middle, a polygon 2 is moved in a circular manner. The polygon 2 has three flat surfaces on each of which a plunger foot plates 3 is arranged in a sliding manner. The polygon 2 and the plunger foot plate 3, which can also be called plunger plates, are in a sliding contact with one another. By moving the polygon 2, a preferred sliding direction is defined between the polygon 2 and the plunger foot plate 3. Diesel fuel is provided in the region of polygon 2 and plunger foot plate 3 as sliding agent, but which is also present on the side in the region of the gap between the polygon 2 and the plunger foot plate 3.

Figure 2:
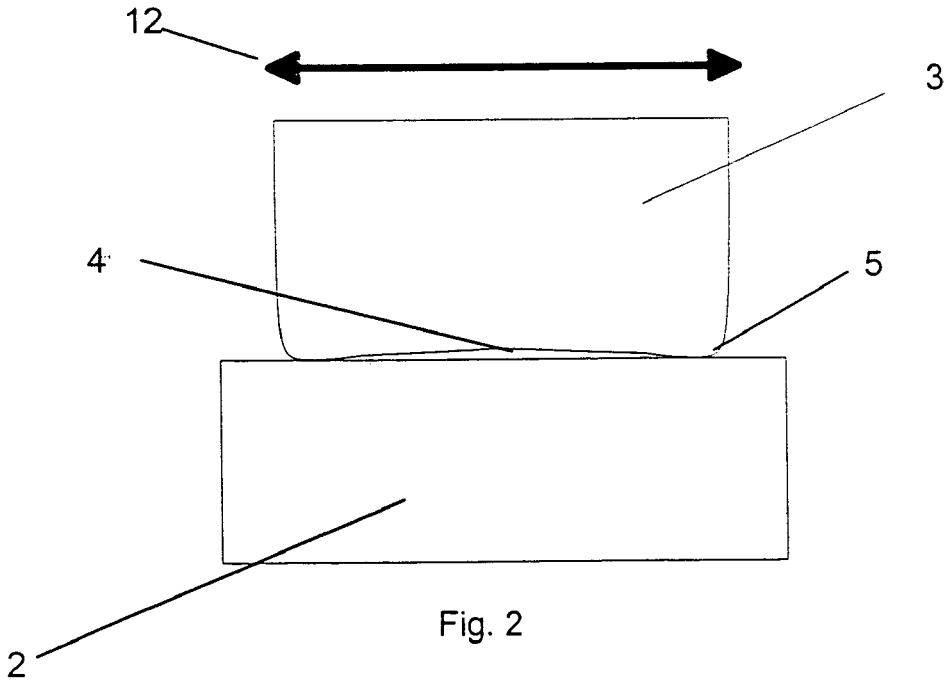
FIG. 2 shows two bodies which are supported so that they slide against one another.

FIG. 2 shows a diagrammatic representation of the plunger foot plate 3 and polygon 2. The representation shows that the plunger foot plate 3 lies on the polygon 2 or on a flat surface of polygon 2 over a large area. The plunger foot plate 3 is made to be concave in the central region of the contact surface between the plunger foot plate 3 and the flat surface of polygon 2. Thus, an increased intermediate space 4 is produced between the two bodies, as a result of which the gap between them increases significantly. A reservoir of the sliding agent can be produced in this intermediate space to improve lubrication and to reduce the frictional value. The arrangement of the concave form of the plunger foot plate 3 is chosen so that it is arranged in the region of the largest pressure load. This region is established by the fact that the piston shaft of the high-pressure pump 1 is arranged on the side of the plunger foot plate 3 which is away from the concave region and as a result of this a strong load of the plunger foot plate 3 is produced especially in the direction of polygon 2. Through the concave design, this effect is weakened. Sufficient lubrication and reduction of the frictional coefficient and thus increased life is achieved. In addition, the plunger foot plate 3 has rounded edges in the boundary region of the contact area to the polygon 2, that is, it is convex. As a result of this, a narrowing gap is created through which a safe development of the lubricant film between polygon 2 and the plunger foot plate 3 is achieved. This lubricant film is further improved additionally by the presence of the cavities shown in FIG. 3.

In addition, the development of cavities in the surface of the plunger foot plate 3 or of the polygon 2 is added to the special designs of the creation of the plunger foot plate 3.

Figure 3:
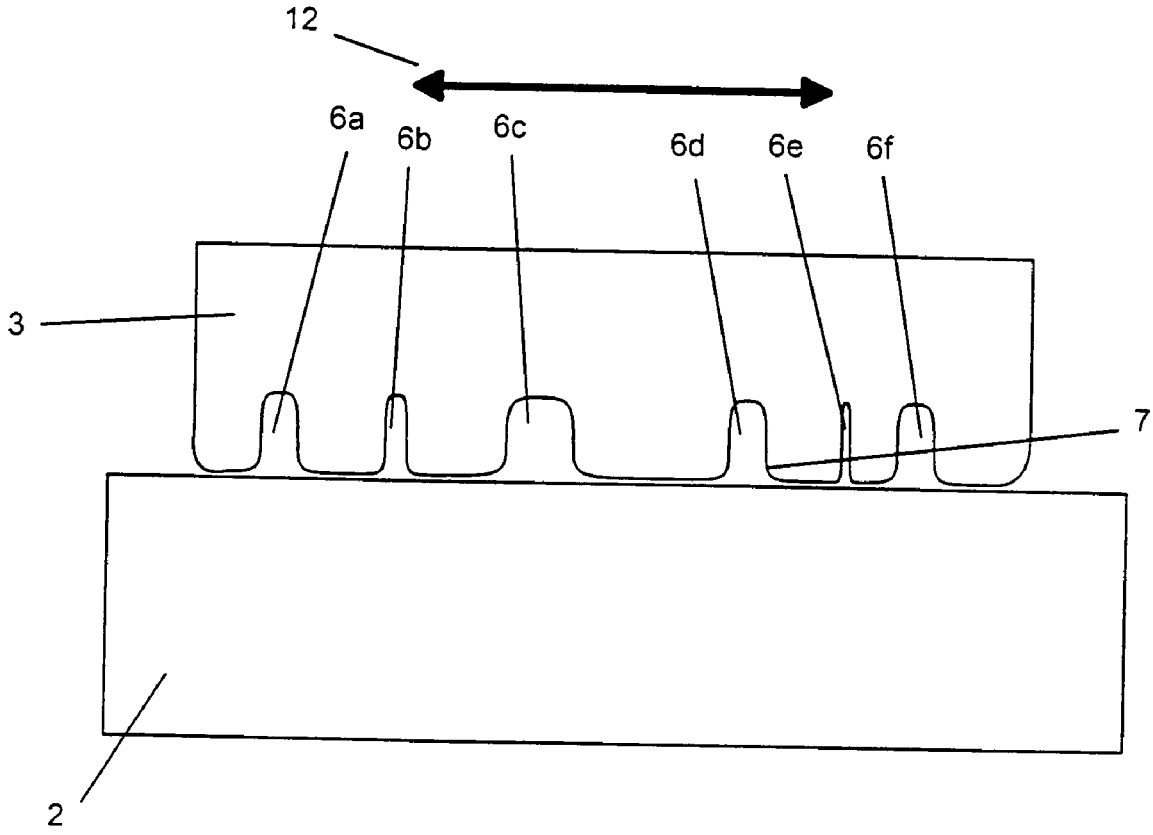
FIG. 3 shows an example of the design of the cavities according to the invention.

FIG. 3 shows the plunger foot plate 3 which is supported on a polygon 2 in a sliding manner according to FIGS. 1 and 3. The plunger foot plate 3 shows several cavities 6*a, b, c, d, e* and *f*. The cavities 6*a* to *f* have different depths and widths. In the selected cross-sectional representation, the different lengths of these cannot be recognized. The length extension is oriented transversely to the preferred sliding direction, which is indicated with arrow 12. By the pronounced longitudinal extension, the possibility is created to develop a significant reservoir of sliding agent in the cavities 6*a* to *f* and to make available a lubricant film in the contact areas which are formed by the intermediate regions between the cavities 6*a* to *f*.

The cavities 6*a* to *f* show a depth of at least 5 μm and typically less than 50 μm as well as a width of more than 10 μm to several 100 μm. The longitudinal extensions are of a size of several 100 μm.

As a result of the cavities 6*a* to *f*, protrusions are formed which have a largely flat surface and form a significant sliding surface. As a result of the size of the sliding surface, it is possible to prevent large point loads or surface loads of the body upon mutual sliding and as a result of that damage is excluded or limited. Moreover, this is enhanced by the formation of edge regions which are formed by the meeting of the cavity 6*a* to f and the protrusions. These transition regions are formed so that they are rounded and as a result of the rounding a wedge-shaped narrowing of the reservoir and of the lubricant film occurs in the direction of preferred sliding direction. As a result of this design, the formation or the development of the lubricant film is achieved which has a significant influence on the frictional values between the two bodies. Especially, as a result of this design, it is possible to optimize the hydrodynamics of the sliding agent so that the frictional value can be kept low even at high pressures or surface loads. Moreover, as a result of the wedge-shaped design, which is defined by the distance and by the floating of the two bodies against one another, can be increased and as a result the lubricant action, which again has a positive effect on the frictional value, can be improved.

The cavities 6*a* to *f* are preferably created by flat grinding transversely to the preferred sliding direction. Then the protrusions are leveled with the aid of vibratory grinding, for example, with the Ceramo-Finish of the Rösler Company, and are brought into the desired form.

Figure 4A:
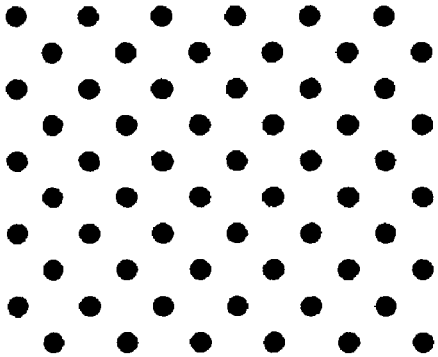
FIG. 4 shows two examples of the design of the surface in top view.

FIG. 4*a* shows the surface of a body according to the invention in top view. These cavities have a cylindrical shape. Their diameter lies between 30 and 100 μm. Their depth lies in the range of 20 μm. The cavities are uniformly distributed over the surface, whereby they are arranged in rows so that the successive rows are displaced sideways with respect to one another. As a result of this a very tight arrangement of cavities is produced on the surface. The distance between the rows is 200 μm here. The distance between the neighboring cavities of two neighboring rows is about 280 μm. Through this arrangement, a very uniform distribution of the cavities on the surface is achieved, which creates the possibility to achieve a very low and comparable friction in different sliding directions. A preferred sliding direction thus does not exist. This is made possible by the fact that there are very effective reservoirs in the various directions for making the sliding agent available when the two different surfaces of the bodies slide on one another.

Figure 4B:
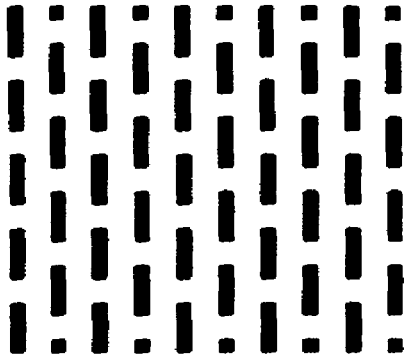

According to the special design of the surface as is shown in FIG. 4*b*, the cavities essentially have a basic rectangular form. They have a length of several 100 μm, especially 1000 μm, while they have a width of a few 10 μm, especially 60 μm. The depth of the cavities is about 30 μm. The cavities with an essentially rectangular cross-section are arranged in rows, where the cavities in one row are arranged with a distance of several 100 μm, typically 500 μm to one another. Here the rectangular cavities are oriented so that their longitudinal direction is chosen to be equal to the orientation of the row. The distance of the rows is chosen in the range from 100 to 3000 μm, especially 500 μm. Through the sideways displacement of the neighboring rows with respect to one another shown in FIG. 4*b*, it is achieved that the cavities of one row occur at a gap between the cavities of the other row. When a body with a surface according to 4*b* slides over another body, then it exhibits a significantly reduced frictional coefficient, as long as the direction of sliding is essentially transverse to the main direction of the rectangular cavities and thus it is oriented essentially transversely to the direction of the rows. The more the direction of sliding and the main orientation approach each other, the less pronounced is the improvement of the frictional coefficient. As a result of the selected depth of the cavities, in combination with the lateral extensions of the cavities, a very effective reduction of the frictional coefficient of the order of about 20% is achieved in comparison to a uniformly smooth surface without pronounced protrusions or cavities.

The cavities shown in FIGS. 4*a* and 4*b* are produced by chemical etching, using an etching mask during the chemical etching which was perforated very economically and efficiently with a so-called pin feed drum.

The invention claimed is:

1. A surface of a polygon (2) and/or a plunger foot plate (3) of a high-pressure injection pump for a diesel motor, wherein said surface slides over another surface, wherein at least one of said surfaces has cavities at least in the contact area between the polygon (2) and the plunger foot plate (3), wherein the side of the plunger foot plate (3) facing the polygon (2) is formed to be concave at least in the load free state, and wherein the cavities have a depth in the range from 5 to 50 μm and (a) a width of 30 to 100 μm and a length of at least 100 μm or (b) a diameter in the range of 30 to 100 μm, and wherein the edges of the cavities are rounded.

2. A surface according to claim 1, wherein the cavities are formed in a cup, trough, groove or trench shape.

3. A surface according to claim 1, wherein the cavities are formed in a wedge shape in the direction of the preferred sliding direction.

4. A surface according to claim 3, wherein said wedge narrows in the preferred sliding direction.

5. A surface according to claim 3, wherein said surface is provided over at least a part thereof with a sliding improving and/or corrosion reducing coating.

6. A surface according to claim 3, wherein the surface of the plunger foot plate (3) is convex in the boundary region of the contact region between the polygon (2) and the plunger foot plate (3).

7. A method for the preparation of a surface provided with cavities for the polygon (2) and/or the plunger foot plate (3) of a high-pressure injection pump for a diesel motor, comprising:

first introducing the cavities into the surface with the aid of chemical etching, by blasting with blasting agents or with laser removal processes, and then flattening surface using vibratory grinding and the edges of the cavities are rounded wherein the cavities have a depth in the range from 5 to 50 μm and (a) a width of 30 to 100 μm and a length of at least 100 μm or (b) a diameter in the range of 30 to 100 μm, and wherein the edges of the cavities are rounded.

8. A method according to claim 7, further comprising additionally providing a hardening and/or coating over at least a part of said surface to improve sliding and/or reducing corrosion of the surface.

9. A high-pressure injection pump for a diesel motor, said pump including a rotating polygon which comes into contact with plunger foot plates in a sliding manner, wherein a sliding surface of at least one of said polygon (2) and/or plunger foot plate (3) has cavities at least in the contact area between the polygon (2) and the plunger foot plate (3), wherein the side of the plunger foot plate (3) facing the polygon (2) is formed to be concave at least in the load-free state and wherein the cavities have a depth in the range from 5 to 50 μm and a width of 30 to 100 μm and a length of at least 100 μm or a diameter in the range of 30 to 100 μ, and wherein the edges of the cavities are rounded.

* * * * *